US005253434A

United States Patent [19]

Curley, Jr. et al.

[11] Patent Number: 5,253,434

[45] Date of Patent: Oct. 19, 1993

[54] WATERPROOF ARTICLE OF MANUFACTURE AND METHOD OF MANUFACTURING THE SAME

[75] Inventors: John J. Curley, Jr., Dunstable; Jon L. Bemis, Middleboro, both of Mass.

[73] Assignee: Reebok International Ltd., Stoughton, Mass.

[21] Appl. No.: 29,968

[22] Filed: Mar. 9, 1993

Related U.S. Application Data

[63] Continuation of Ser. No. 612,669, Nov. 14, 1990.

[51] Int. Cl.[5] ..... A43B 23/07; A43B 10/00

[52] U.S. Cl. ..... 36/55; 12/142 F; 12/142 RS

[58] Field of Search ..... 12/142 E, 142 EV, 142 F, 12/142 RS, 142 T; 36/55

[56] References Cited

U.S. PATENT DOCUMENTS

| | | | |
|---|---|---|---|
| 177,656 | 5/1876 | Osgood | 36/55 |
| 1,972,976 | 9/1934 | Burnham et al. | 12/142 |
| 2,002,527 | 5/1935 | Dorogi et al. | 18/59 |
| 2,883,316 | 4/1959 | Leahy et al. | 154/50 |
| 3,035,291 | 5/1962 | Bingham, Jr. | 12/142 |
| 3,350,795 | 11/1967 | Schlecht | 36/2.5 |
| 3,416,174 | 12/1968 | Novitske | 12/142 |
| 3,552,041 | 1/1971 | Batchelder et al. | 36/43 |
| 4,292,746 | 10/1981 | Delaney | 36/83 |
| 4,295,238 | 10/1981 | Clark | 12/142 RS |
| 4,599,810 | 7/1986 | Sacre | 36/55 |
| 4,809,447 | 3/1989 | Pacanowsky et al. | 36/84 |
| 4,819,345 | 4/1989 | Mulcahy et al. | 36/17 R |
| 4,899,411 | 2/1990 | Johnson et al. | 12/142 E |
| 4,901,450 | 2/1990 | Chemello et al. | 36/10 |
| 4,943,475 | 7/1990 | Baker et al. | 427/340 |

FOREIGN PATENT DOCUMENTS

| | | |
|---|---|---|
| 690392 | 9/1930 | France . |

*Primary Examiner*—Steven N. Meyers
*Assistant Examiner*—Marie Denise Patterson
*Attorney, Agent, or Firm*—Sterne, Kessler, Goldstein & Fox

[57] ABSTRACT

A waterproof article of manufacture and method of manufacturing the same including a waterproof, breathable shell and an aqueous based waterproof sealant disposed on the shell adjacent seams used to assemble the shell into an article. The article may be a lining for footwear.

20 Claims, 6 Drawing Sheets

WATERPROOF ARTICLE OF MANUFACTURE AND METHOD OF MANUFACTURING THE SAME

This application is a continuation of application Ser. No. 07/612,669, filed Nov. 14, 1990.

FIELD OF THE INVENTION

The present invention relates to a waterproof article of manufacture and method of manufacturing the same; and more particularly to a waterproof article of footwear and method of manufacturing the same.

BACKGROUND OF THE INVENTION

It is an important aspect of articles to be used outdoors or in wet or damp environments that they be impervious to water and moisture. Traditionally this has required that such articles be entirely coated with a waterproof compound such as rubber that renders then non-breathable, and therefore, uncomfortable when worn or used in close proximity to the body. One Example of such an article of footwear coated with rubber to make it waterproof is found in U.S. Pat. No. 1,972,976 to Burnham et al. Despite that this construction prevents outside water and moisture from entering the footwear, the rubber coating maintains all moisture, including perspiration, within the footwear, making the article very uncomfortable for prolonged wear. Thus, a material suitable for use in a wet environment and capable of moving perspiration away from the body was necessary.

To this end, various materials have been developed that are waterproof, but are also water vapor permeable. One example is the material available under the trademark GORE-TEX® available from W. L. Gore & Associates, Inc. of Newark, Del. Another example of a waterproof, breathable fabric is sold under the name NEPTUNE TM by Tempo/Shain Corporation of Peabody, Mass. Both of these materials utilize a porous membrane that has a pore diameter small enough to prevent water molecules from passing through, but large enough to permit water vapor molecules from passing through.

A problem with the use of these membrane materials in constructing waterproof articles of manufacture, be it footwear, apparel, camping gear, etc., is the water leakage that occurs along seams used to join various pieces of the material together to form the article. One solution to this problem is found in U.S. Pat. No. 4,599,810 to Sacre (assigned to W. L. Gore & Associates, Inc.). The Sacre patent describes a liner for footwear including a waterproof seam construction in which a tape comprising a nylon layer, a GORE-TEX® membrane layer, and an adhesive layer is laminated to the seams forming the liner. While this structure has proven successful in preventing water penetration, it is a very labor intensive process, requiring the collation of many parts by skilled workers. Therefore, is not wholly reliable and is not ideally suited for mass production.

Another example of a technique for waterproofing seams of footwear is found in U.S. Pat. No. 3,035,291 to Bingham, Jr. The Bingham patent discloses, in FIG. 3, a waterproof seam construction similar to the Sacre patent in that the seams are covered with a plastic adhesive coated tape. In the alternative, as shown in FIG. 5 of the Bingham, Jr. patent, a ply of gum rubber or suitable synthetic plastic may be interposed between plies of material adjacent the seams to seal the same. While this patent discloses waterproof seams structures, it too suffers from the problems associated with the Sacre patent in that the processes are very labor intensive and therefore, expensive.

U.S. Pat. No. 4,901,450 to Chemello (assigned to Salomon S. A. Annecy of Cedex, France) discloses an inner boot madê of open cell foam for a ski boot. A lower portion of the inner boot is coated with polyurethane that seals against moisture and humidity. While the patent explains that the disclosure may be applied to inner boots of the stitched or sewn type, it does not provide for the coating to be selectively applied, for example, only adjacent the stitching or sewing. Thus, if applied to an inner boot made of breathable fabric, the breathability of the entire lower portion of the boot would be lost. Such a construction is unacceptable to today's consumer who wants an article to be waterproof, but does not want to sacrifice comfort by giving up breathability.

Thus, the need exists for a waterproof article of manufacture that is both waterproof and breathable, that avoids the problem of water penetration adjacent seams by providing a simple and cost effective seal. It is with this in mind that the present invention was developed. The present invention reduces the number of manual operations necessary in current waterproofing methods, and therefore, is more cost effective and reliable.

SUMMARY OF THE INVENTION

The present invention is embodied in a waterproof article of manufacture comprising a shell which includes a seam, and an aqueous based waterproof sealant disposed on an outer surface of the shell only adjacent the seam. The article may be a lining for footwear. The shell may be comprised of two pattern pieces joined by the seam. The two pattern pieces may include an upper piece and a sole piece; or may include two similarly shaped halves of the article. The shell may be comprised of a waterproof, breathable material and the sealant may be disposed on an exterior outer surface of the shell. The sealant is preferably a thermosetting, two component, polyurethane system.

The present invention is also embodied in a method of manufacturing a waterproof article of manufacture. The method comprises the steps of selecting a pattern for the article, seaming the pattern to form a shell, providing the shell on a support, applying a waterproof sealant to an outer surface of the shell only adjacent the seam, allowing the sealant to cure, removing the shell from the support, and assembling the shell into one article of manufacture. The method may further comprise the steps of re-applying the sealant atop the first application after the first curing step and allowing the re-application to cure before removing the shell from the support. The pattern pieces may be seamed by the stitching. The sealant may be applied by painting, spraying or dipping. The sealant is preferably applied to an outer surface of the shell, and is allowed to cure at room temperature. In a preferred embodiment, the shell is assembled into an article of footwear. The present invention is also embodied in the article of manufacture produced by the above method.

DESCRIPTION OF THE PREFERRED EMBODIMENTS

Figure 1:
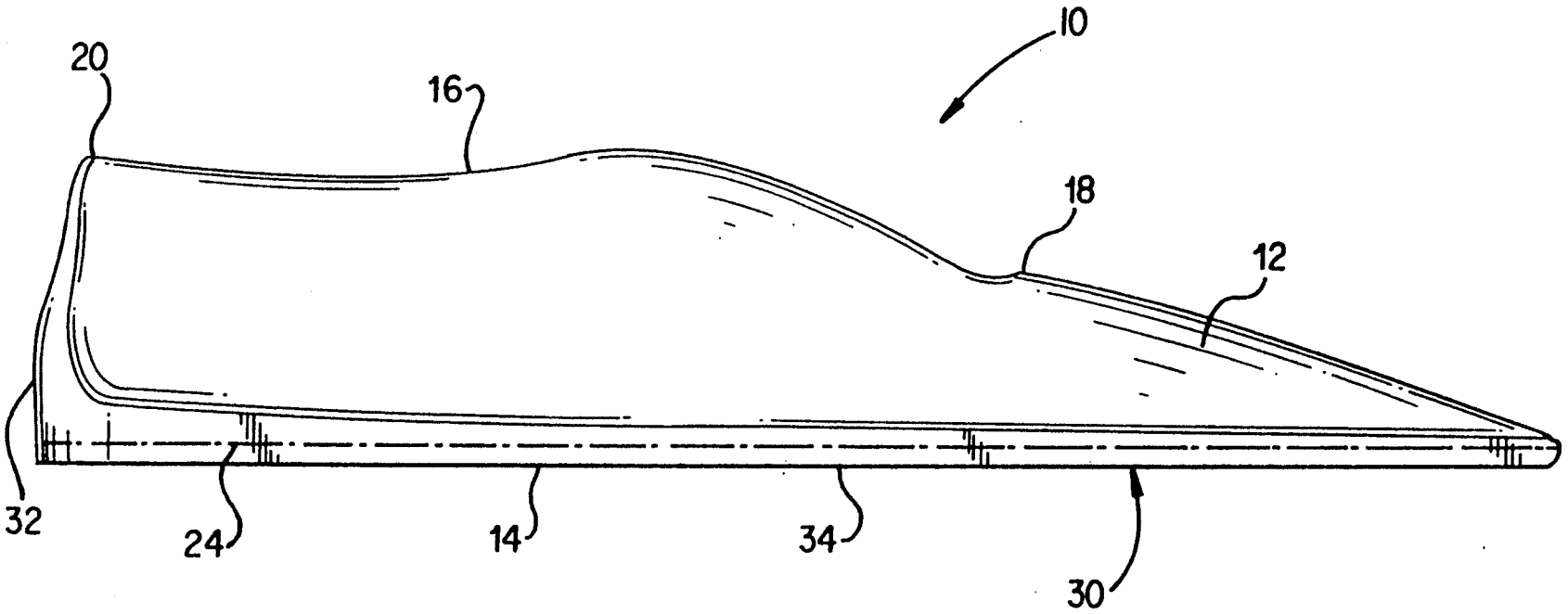
FIG. 1 illustrates a side view of one embodiment of a waterproof article of manufacture of the present invention.

With continuing reference to the drawings in which similar reference numerals are used to describe similar parts, two embodiments of the present invention are shown. In particular, a waterproof lining for an article of footwear is shown. The term lining is intended to mean any interior layer of a boot or shoe upper. Therefore, the term lining includes both a traditional liner (i.e., the inside layer of a shoe upper closest to the foot of a wearer) and an interior or interlining disposed between a traditional liner and the upper. The terms boot and shoe are used herein interchangeably and are intended to refer to all types of footwear, including athletic, casual and dress shoes made of flexible and non-flexible materials. Furthermore, while the present invention is being described with regard to an interlining for footwear, it is to be understood that the principles and processes are applicable to the construction of other waterproof articles of manufacture including but not limited to apparel, tents and other outdoor or camping gear, for example.

The lining of FIG. 1 is comprised of a shell shown generally at 10 and a seam sealant shown generally at 30. Note that a lining for the right foot or shoe is shown, and that a lining for the left foot would be a mirror image of the one shown. Shell 10 is comprised of two pattern pieces, a foot piece 12 and a sole piece 14. Foot piece 12 encompasses the foot of a wearer and includes a foot opening 16 through which the foot of the wearer is inserted when the shell 10 is assembled into an article of footwear. Opening 16 includes a toe portion 18 and a heel portion 20. A heel seam 22 (shown in phantom in FIG. 2) is provided at heel portion 20 of opening 16. Heel seam 22 helps to form foot piece 12 into shell 10 which encompasses the top portion of the foot of a wearer. Sole piece 14 which generally follows the profile of a human foot, is attached to foot piece 12 along a perimeter seam 24 (shown in phantom in FIG. 1) to complete shell 10.

Figure 2:
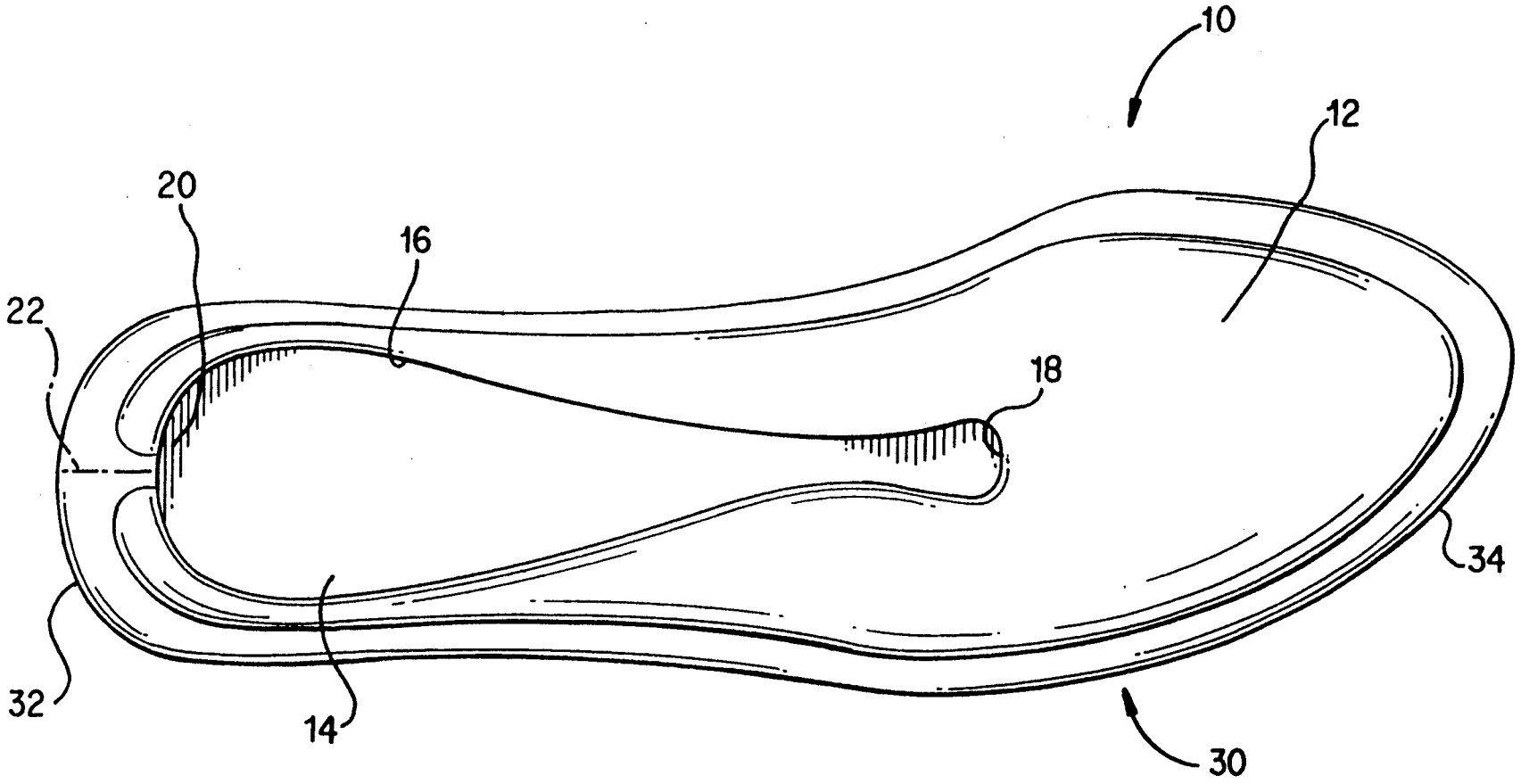
FIG. 2 illustrates a top view of the same.
Figure 3:
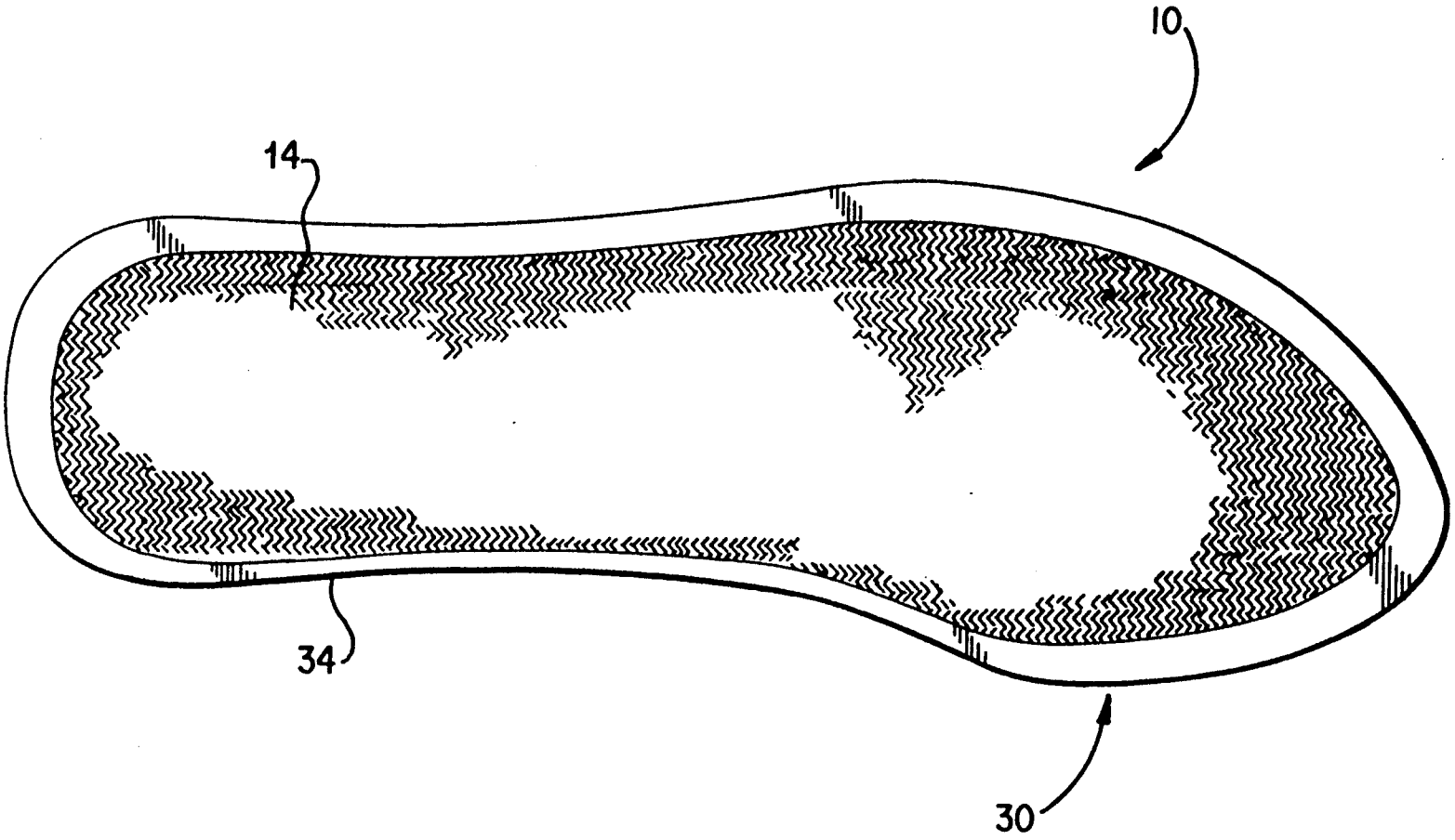
FIG. 3 illustrates a bottom view of the same.
Figure 4:
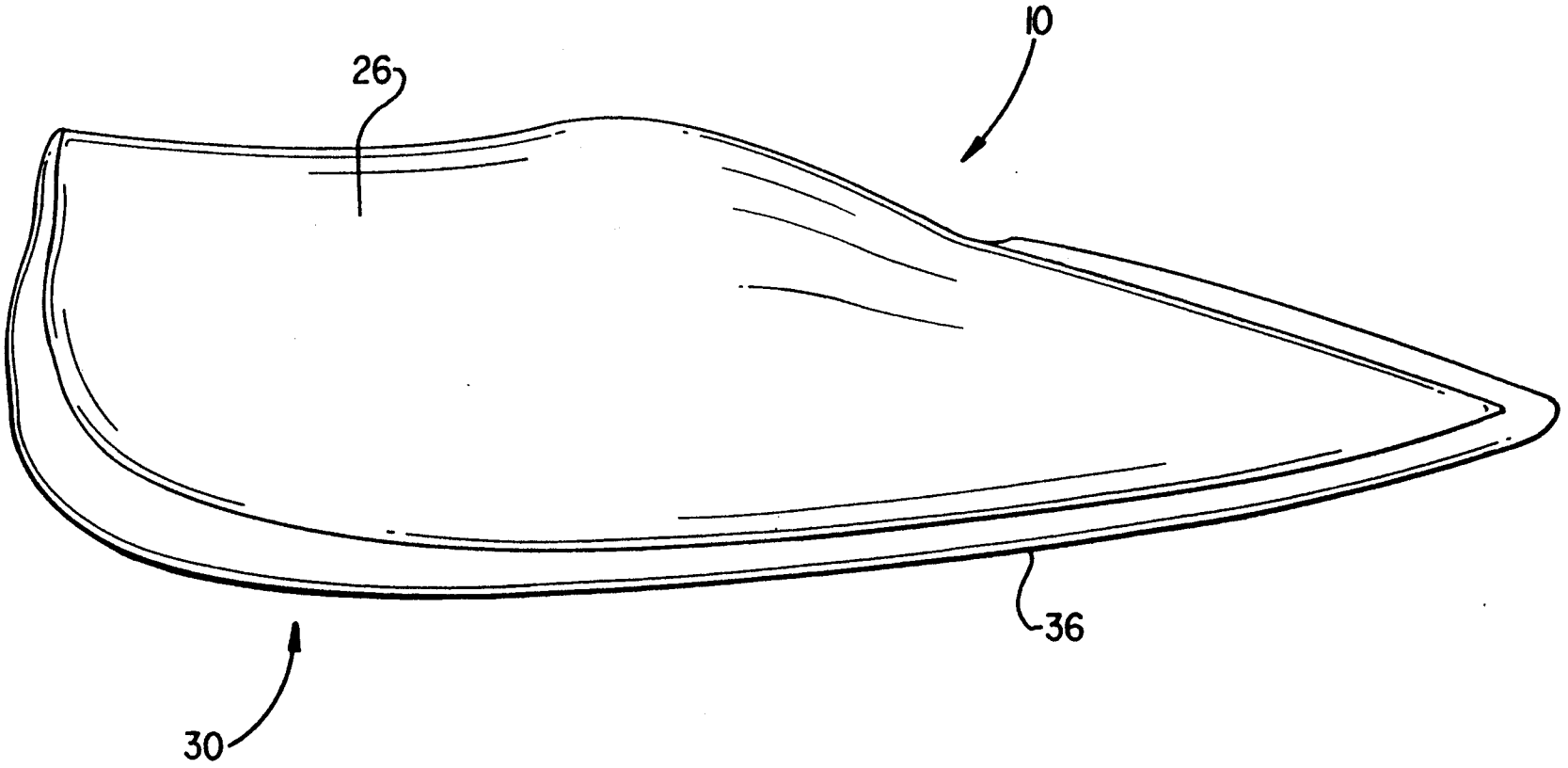
FIG. 4 illustrates a side view of a modified embodiment of the invention of FIG. 1.
Figure 5:
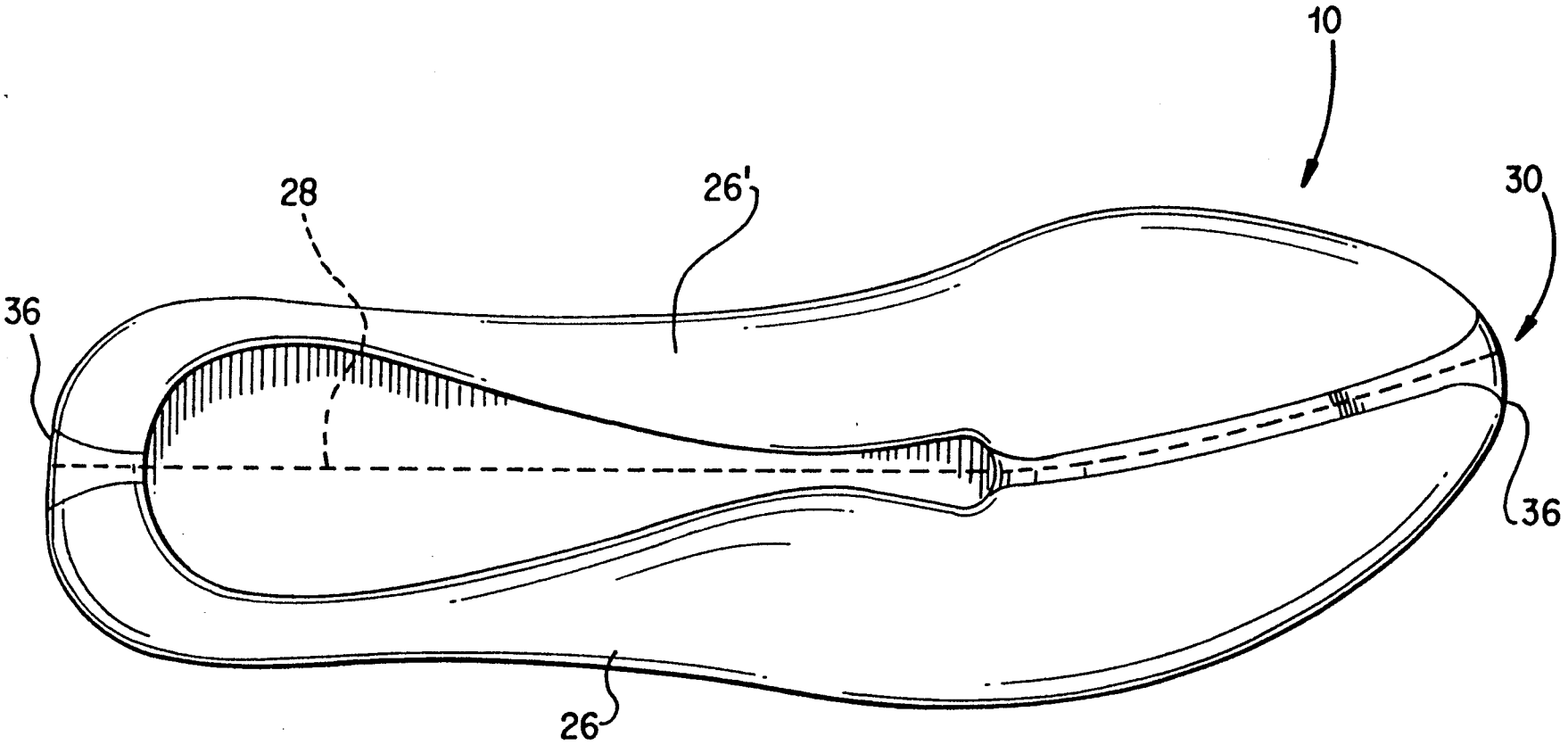
FIG. 5 illustrates a top view of the same.

In the modified embodiment of FIGS. 4 and 5, a shell similar to that of FIGS. 1, 2 and 3 is shown. The shell of this embodiment also comprises two pattern pieces, substantially equal halves 26 and 26'. Half pieces 26 and 26' are joined along a longitudinal seam 28 which extends from the toe portion 18 of foot opening 16 to the heel portion 20 to form shell 10.

While each of the illustrated embodiments is comprised of two pattern pieces, it should be understood that patterns that involve only a single pattern piece such as that shown in U.S. Pat. No. 2,848,835 to Goodman are applicable to the present invention. However, it has been shown that in order for the lining to most closely mimic the profile of the foot, several pattern pieces should be used, the pattern illustrated in FIGS. 1, 2 and 3 being the preferred.

Figure 6:
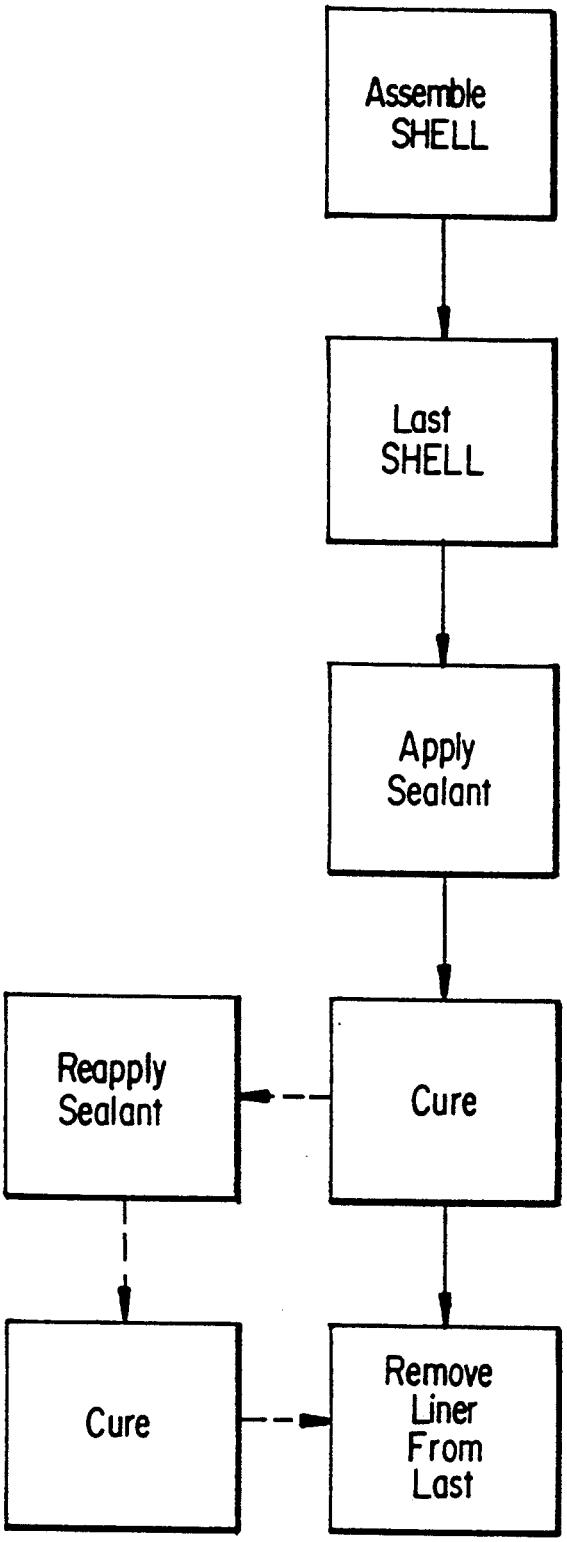
FIG. 6 is a flow chart illustrating the steps of the method of manufacture of the illustrated embodiments of the present invention.

The method of manufacturing a waterproof article of manufacture and the preferred materials for use with that method to achieve the desired results will now be described with reference to FIG. 6 of the drawings. FIG. 6 is a flow chart which illustrates the preferred method of manufacturing the shoe linings of FIGS. 1-5. However, it should be understood that the described method is applicable to sealing seams of a variety of waterproof articles of manufacture.

The method of manufacturing both of the illustrated embodiments of the present invention comprises several steps, the first of which is to assemble the shell. As discussed above, the lining of the present invention may serve as either the traditional upper lining for an article of footwear or as an interlining positioned between a conventional liner and the upper. Thus, the terms lining and liner as used herein may refer to either construction. The material for the shell may be selected from a variety of materials conventionally used for the manufacture of shoe linings, for example canvas and nylon. If it is desired that the liner be waterproof, then materials exhibiting such qualities are preferred, such as natural or synthetic latex. However, if it is preferred that the liner exhibit qualities such a breathability and comfort, then materials that prevent water penetration, but allow penetration of water vapor should be considered for the liner. Examples of such materials are GORE-TEX® (available from W. L. Gore & Associates, Inc. of Newark, Del.) and NEPTUNE TM (available from Tempo/-Shain Corporation of Peabody, Mass.). As discussed above, the construction of the GORE-TEX® membrane is described in U.S. Pat. No. 4,599,810 which is incorporated in its entirety herein by reference.

Although the membrane may be used alone, it is preferably laminated to a textile layer by any known technique. The textile layer contributes to the overall stability of the liner. In the preferred embodiment, the membrane is sandwiched between two textile layers. A suitable textile layer should be breathable (preferably exhibiting values in excess of 3.0 cubic feet/square feet/minute; ASTM D-737), light in weight (preferably 60-180 grams/meter square; ASTM D-1910) and dimensionally stable (preferably a tensile minimum of 4 kg/cm; ASTM D-1682 and a elongation minimum of 15% and a maximum of 140%; ASTM D-1682). The moisture regain of the material should be preferably below 2.5% (ASTM D-570). Such a textile layer should be capable of enduring the manufacturing steps set forth below. One example of a suitable textile layer is a nylon warp knit of 70 denier filament yarn in a tricot configuration produced on a flat bed knitting machine. The weight of such a knit material is approximately 90 grams/meter squared. Although synthetic fibers are preferred over natural fibers, an infinite number of suitable materials exist and may be combined using a variety of knit, woven and non-woven structures.

With the appropriate material for the shell chosen, the shell pattern is selected. As noted above, the pattern may be one piece or several pieces. The advantage of a one piece pattern is that it is easier to assemble and requires less skilled workers because of the minimum number of parts. This, in turn contributes to a lower cost per liner. However, a liner made of multiple pieces is easier to conform to the asymmetrical shape of the human foot. This eliminates unnecessary excess material when the liner is positioned in footwear, which results in a better fitting more superior product.

The chosen pattern is cut from the laminated material in accordance with any known fabric cutting technique (e.g., die cutting and laser). The cut pieces are assembled into a liner by the formation of seams along the periphery of the pieces. For example, in the embodiment shown in FIGS. 1, 2 and 3, two seams are provided; a heel seam 22 along the back part of the shell 10 and a perimeter seam 24 along the periphery of the sole piece 14 and the foot piece 12. It is possible, however, that a single seaming operation could result in a continuous heel and perimeter seam. In some instances, it may not be necessary for sole piece 14 to be formed of a vapor permeable membrane, particularly where no air transfer below the foot is likely to occur. In the embodiment of the invention shown in FIGS. 4 and 5, one longitudinal seam 28 is provided from the toe portion 18 of foot opening 16 to the heel portion 20. The seams may be formed by any known stitching or laser technique, however, the preferred stitching method is merrow. It is also possible to join pattern pieces by zig-zag, flat bed, post and bone stitching machinery.

The assembled liner is slipped over a conventional shoemaking last configured for the particular shoe in which the liner is to be used. While the method is described with particular reference to a shoemaking last, any suitable support may be substituted, particularly where the article produced by the method is something other than a shoe. For example, a spring loaded multidimensional jig which supplies support only along the seams of the article may be used. With the liner properly oriented on the last, the liner is ready for application of the sealant to the seams. The sealant is preferably an aqueous based solution and therefore, can be applied by various methods including painting, spraying and dipping. The term aqueous refers to the sealant being in a substantially liquid form when applied, but taking on a substantially dry form upon evaporation of a carrier. This is described in greater detail below with regard to the sealant composition.

It is important that the method chosen result in the seams being covered with a sufficient application of sealant to prevent ingress of water and moisture. If the sealant is to be painted or sprayed on the liner, either manually or by machine, the sealant is provided on a brush or in a spray or similar device for applying the sealant to the exterior outer surface of the shell. Because the sealant is not necessarily breathable, it is preferred that the sealant be provided only adjacent the seams. This is particularly desirable in the case of a shell made of waterproof, breathable material to ensure that the shell remains breathable. In this preferred embodiment, the sealant should extend from 10 to 15 mm along either side of the seams.

The sealant may also be applied by dipping the shell in a bath of suitable sealant, by hand or by machine, to coat the seams. The liner of the embodiment of FIGS. 1, 2 and 3 can be dipped once in a vertical direction to coat heel seam 22 and then in a circling motion to coat the perimeter seam 24. The longitudinal seam 28 of the liner of the embodiment of FIGS. 4 and 5 can be coated by a circular motion as well. In either case, immersion of the liner in the bath should occur for no less than three seconds.

After application of the sealant to the liner, the sealant should be allowed to cure with the liner in place on the last. Such curing may take place either at room temperature or in a curing tunnel or other device with low humidity and high temperature. The liner should cure for at least eighteen minutes when performed at room temperature. If a curing tunnel is provided, the last time can be reduced to four to six minutes provided that the tunnel temperature is 50° C. or above. Following the cure step, the liner can be removed from the last for a post cure period before being incorporated into footwear. Twenty-four hours at room temperature is sufficient unless post curing equipment is used. In the alternative, the sealant may be re-applied to the liner seams substantially in the same position as the first application step. The method of re-application may be the same as the first method of application. Similarly, a curing step must follow to ensure that the sealant is sufficiently set before removing the liner from the last or incorporating the liner into footwear.

With the sealant sufficiently cured, the liner is ready to be incorporated into footwear. To assemble the liner into a shoe with a conventional sock lasted shoe lining (i.e., the liner serves as an interlining), the shoe lining is attached to the shoe upper at the top line (foot opening of the upper) and is slipped over a last. The upper is extended from the top of the liner in a position opposite to the last. The liner of the present invention is slipped over the lasted lining and is pulled up toward the top line. The upper is pulled down over the liner and is board lasted leaving the liner sandwiched between the shoe lining and the shoe upper (i.e., it is not necessary that it be attached to either the lining or the shoe upper). It is important to note that this method is not limited to only board lasted shoes, but to any method of shoe construction where the lining can be lasted separately from the shoe upper, such as hand sewn footwear and certain types of direct-attach bottoming or soling methods.

If the liner of the present invention is to also serve as the interior lining of the shoe, it is preferred that the interior surface, that which will face the foot of a wearer, be provided with a napped surface such as CAMBRELL® material available from Faytex Corporation of Braintree, Mass. The napped liner would be substituted for one of the textile layers in the preferred sandwich construction above description, by sock lasting the sealed liner and attaching a shoe upper along the top line. The upper and liner are lasted and an outsole is attached to complete the shoe.

Additionally, an adhesive applied using a microdot method can be used to secure the liner to the footwear upper. In particular, a thermoplastic hot melt adhesive or resin, for example, polyethylene, vinyl polymers and co-polymers, polystyrene, polycarbonate and polyamides. Compounded with the resin are additives such as fillers and reinforcers, plasticizers and other modifiers. In the case of the liner which is sandwiched between a traditional lining and the shoe upper, the adhesive compound is applied to both the exterior and interior surfaces of the liner (i.e., both exterior surfaces of the sandwich). In the case of the liner also serving as the lining of the shoe, the sealant is applied only to the exterior of the liner, i.e., the side of the liner which faces the inside surface of the shoe upper. In some applications, it may be advantageous to apply the micro dot to the back side of the inside lining (i.e., the side of the lining which faces the inside surface of the interlining), as well as the exterior of the interlining (i.e., the side which faces the inside surface of the shoe upper). The adhesive may be applied by a solvent carrier or by conventional melt equipment. The density of the dots may vary depending on the end use requirement. In the preferred embodiment, 200 dots/square inch with a volume of 0.05 cc are used. The lasted liner and shoe upper is subjected to heat sufficient to bring the adhesive to "tack" (i.e., it becomes sticky) resulting in a bond between the upper and the liner; and in the case of the liner forming the interlining, also between the liner and the lining.

Appropriate sealant composition for the present invention will now be described. In its preferred embodiment, and in particular where the sealant is to be applied to small quantities of articles at a time, the sealant is comprised of a solvent carrier and urethane based polymer components (e.g., polyol and isocyanate). Where the sealant is to be applied in mass quantities and in particular by dipping articles in a large bath, the sealant is preferably water based, that is water is substituted for the solvent. For example, a compound containing neoprene rubber solids, a curing agent, wetting agents, an accelerator and treated water such as vultex FFG-689-A from General Latex and Chemical Corp., has proven successful for the dipping method.

In its preferred embodiment, the sealant is a thermosetting, two component, polyurethane system. This system is based on polyhydroxy alcohol groups which, when combined with an isocyanate (just prior to application), react to form a polymer of the polyurethane family. The isocyanate acts as the catalyst or crosslinking agent. The system is carried by solvent (methyl ethyl ketone or the like) which evaporates following application, leaving a nonporous, chemically crosslinked, flexible, water-impermeable coating.

It is preferred that two separate coats of sealant, which share compatibility, but which are slightly different in makeup, be applied. A first application of sealant (primer) is slightly more on the thermoplastic side as it uses a lower volume of catalyst. This somewhat inhibits the crosslinking process and allows the second application (20–30 minutes later) to coalesce with the first coat.

Both variations are carried by solvent, but the volume of solvent varies with the primer solution using higher amounts of solvent carrier. The purpose of this is to lower the percentage of solids of the sealant, which in turn lowers viscosity, resulting in better "wetting" and further penetration to the substrate. In addition to the difference in solids content, the primer uses a lower volume of isocyanate (catalyst). Since the isocyanate is the crosslink agent, this lower volume results in a sealant which is somewhat "green," and more on the thermoplastic side (at this point prior to curing). The second coat contains sufficient volumes of isocyanate to polymerize the groups in the solution as well as chemically link the first coat to the second coat. Once the second coat has been applied, the two coats are chemically bonded to each other, as well as to the substrate.

While the present invention has been described with reference to particular means, materials and embodiments, it is to be understood that it is not to be limited to what is described, but extends to all equivalents within the scope of the following claims.

What is claimed is:

1. A method of manufacturing a water proof article of manufacture, said method comprising the steps of:

a. selecting a pattern for said article;
b. seaming said pattern to form a shell;
c. providing said shell on a support;
d. providing a bath of aqueous waterproof sealant;
e. dipping said shell on said support into said bath to coat said seam;
f. allowing said sealant to cure;
g. removing said shell from said support; and
h. assembling said shell into an article of manufacture.

2. A method as set forth in claim 1, wherein said pattern is seamed by stitching.

3. An article of manufacture produced by the method of claim 1.

4. The method of claim 1, wherein said pattern is made of a material that is waterproof and water vapor permeable.

5. The method of claim 4, wherein said article is an article of footwear.

6. The method of claim 1, wherein only said seam of said shell is coated with said sealant.

7. The method of claim 1, wherein said article is an article of footwear.

8. The method of claim 1, wherein said sealant is a thermosetting, two-component system.

9. A method of manufacturing a waterproof article of footwear, said method comprising the steps of:

a. selecting a pattern for said article of footwear;
b. seaming said pattern to form a shell;
c. providing said shell on a support;
d. applying a waterproof sealant to an outer surface of said shell only adjacent said seam;
e. allowing said sealant to cure;
f. removing said shell from said support; and
g. assembling said shell into said article of footwear by sandwiching said shell between a shoe liner and a shoe upper.

10. The method of claim 9, wherein said sealant is applied by painting.

11. The method of claim 9, wherein said sealant is applied by spraying.

12. The method of claim 9, wherein said sealant is applied by dipping said shell on said support into an aqueous bath of said sealant.

13. The method of claim 9, wherein said waterproof sealant is applied to an outer surface of said shell only adjacent said seam.

14. The method of claim 9, wherein said waterproof sealant is allowed to cure at room temperature.

15. The method of claim 9 further comprising the steps of:

a. re-applying said waterproof sealant to said shell atop said first application of sealant after said first curing step; and
b. allowing said re-application of said sealant to cure before removing said shell from said support.

16. The method of claim 9, wherein said pattern pieces are seamed by stitching.

17. The method of claim 9, wherein said pattern is made of a material which is waterproof and water vapor permeable.

18. An article of manufacture produced by the method of claim 9.

19. The method of claim 9, wherein said pattern is comprised of two separate pieces.

20. The method of claim 19, wherein said two separate pieces are comprised of an upper piece and a sole piece.

* * * * *